US008989643B2

(12) United States Patent
Gotoh et al.

(10) Patent No.: US 8,989,643 B2
(45) Date of Patent: Mar. 24, 2015

(54) FIXING DEVICE WITH ENDLESS BELT AND IMAGE FORMING APPARATUS INCORPORATING SAME

(71) Applicants: Hajime Gotoh, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Akira Suzuki, Tokyo (JP); Hiroshi Yoshinaga, Chiba (JP)

(72) Inventors: Hajime Gotoh, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Akira Suzuki, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 13/692,389

(22) Filed: Dec. 3, 2012

(65) Prior Publication Data

US 2013/0170880 A1 Jul. 4, 2013

(30) Foreign Application Priority Data

Dec. 28, 2011 (JP) ..... 2011-289278

(51) Int. Cl.
*G03G 15/20* (2006.01)

(52) U.S. Cl.
CPC ..... *G03G 15/2064* (2013.01); *G03G 15/2053* (2013.01)
USPC ..... 399/329; 399/122; 399/320

(58) Field of Classification Search
CPC . G03G 15/20; G03G 15/206; G03G 15/2064; G03G 15/2053
USPC ..... 399/122, 320, 328–333
See application file for complete search history.

(56) References Cited

U.S. PATENT DOCUMENTS

| | | | |
|---|---|---|---|
| 2006/0029411 | A1 | 2/2006 | Ishii et al. |
| 2007/0212089 | A1 | 9/2007 | Seo et al. |
| 2007/0242988 | A1 | 10/2007 | Seo et al. |
| 2007/0280754 | A1 | 12/2007 | Ogawa et al. |
| 2007/0292175 | A1 | 12/2007 | Shinshi |
| 2008/0025772 | A1 | 1/2008 | Seo et al. |
| 2008/0025773 | A1 | 1/2008 | Ito et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2009/0092423 | A1 | 4/2009 | Shin et al. |
| 2009/0123201 | A1 | 5/2009 | Ehara et al. |
| 2009/0148205 | A1 | 6/2009 | Seo et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0290823 | A1 * | 11/2010 | Okabe et al. ..... 399/331 |

2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0150543 A1 6/2011 Fujiwara et al.
2011/0158718 A1* 6/2011 Fujiwara et al. ..... 399/329
2011/0170917 A1 7/2011 Yoshikawa et al.
2011/0170920 A1 7/2011 Fujiwara et al.
2011/0176821 A1 7/2011 Hase
2011/0176822 A1 7/2011 Ishii et al.
2011/0182634 A1 7/2011 Ishigaya et al.
2011/0182638 A1 7/2011 Ishii et al.
2011/0188909 A1* 8/2011 Suzuki et al. ..... 399/330
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0211881 A1 9/2011 Suzuki et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0236086 A1* 9/2011 Suzuki et al. ..... 399/329
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155932 A1* 6/2012 Nakamura et al. ..... 399/329
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

CN 101799655 A 8/2010
EP 2 317 402 A2 5/2011
EP 2330466 A1 6/2011
EP 2369427 A2 9/2011
JP 2-253282 10/1990
JP 4-044083 2/1992
JP 9-197880 7/1997
JP 2001-215829 8/2001
JP 2002-214953 7/2002
JP 2004-252206 9/2004
JP 2004-286922 10/2004
JP 2006-267901 10/2006
JP 2007-233011 9/2007
JP 2007-334205 12/2007
JP 2010-026256 2/2010
JP 2010-26415 2/2010
JP 2011-137933 7/2011

OTHER PUBLICATIONS

U.S. Appl. No. 13/557,841, filed Jul. 25, 2012, Toshihiko Shimokawa, et al.
Extended European Search Report issued May 22, 2013 in Patent Application No. 12193744.5.
U.S. Appl. No. 13/677,597, filed Nov. 15, 2012, Kawata, et al.
U.S. Appl. No. 13/690,882, filed Nov. 30, 2012, Yoshinaga, et al.
U.S. Appl. No. 13/716,929, filed Dec. 17, 2012, Kawata, et al.
U.S. Appl. No. 13/717,046, filed Dec. 17, 2012, Iwaya, et al.
Office Action issued Dec. 18, 2014 in Chinese Patent Application No. 201210554698.2.
Office Action issued Dec. 1, 2014 in Japanese Patent Application No. 2011-289278.

* cited by examiner

*Primary Examiner* — David Gray
*Assistant Examiner* — Jessica L Eley
(74) *Attorney, Agent, or Firm* — Oblon, McClelland, Maier & Neustadt, L.L.P.

(57) ABSTRACT

The fixing device includes a nip formation assembly partially pressing against an opposed rotary body via an endless belt to form a fixing nip between the endless belt and the opposed rotary body. The nip formation assembly includes a base pad defining the fixing nip and including a pressure portion, an extension portion, and a curved portion. The pressure portion presses against the opposed rotary body via the endless belt. The extension portion is contiguous to and disposed upstream from the pressure portion in a recording medium conveyance direction. The extension portion does not press against the opposed rotary body via the endless belt. The curved portion is disposed upstream from the extension portion in the recording medium conveyance direction and smoothly blends into the extension portion. The curved portion does not press against the opposed rotary body.

18 Claims, 8 Drawing Sheets

FIXING DEVICE WITH ENDLESS BELT AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-289278, filed on Dec. 28, 2011, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time required to output the recording medium bearing the toner image onto the outside of the image forming apparatus after the image forming apparatus receives a print job. Additionally, the fixing device is requested to generate an increased amount of heat before a plurality of recording media is conveyed through the fixing device continuously at an increased speed.

To address these requests, the fixing device may employ an endless belt having a decreased thermal capacity and therefore heated quickly by a heater. FIG. 1 illustrates a fixing device 20R1 incorporating an endless belt 100 heated by a heater 300. As shown in FIG. 1, a pressing roller 400 is pressed against a tubular metal thermal conductor 200 disposed inside a loop formed by the endless belt 100 to form a fixing nip N between the pressing roller 400 and the endless belt 100. The heater 300 disposed inside the metal thermal conductor 200 heats the entire endless belt 100 via the metal thermal conductor 200. As the pressing roller 400 rotating clockwise and the endless belt 100 rotating counterclockwise in FIG. 1 convey a recording medium P bearing a toner image T through the fixing nip N in a recording medium conveyance direction A1, the endless belt 100 and the pressing roller 400 apply heat and pressure to the recording medium P, thus fixing the toner image T on the recording medium P.

Since the metal thermal conductor 200 heats the endless belt 100 entirely, the endless belt 100 is heated to a predetermined fixing temperature quickly, thus meeting the above-described requests of shortening the first print time and generating the increased amount of heat for high speed printing. However, in order to shorten the first print time further and save more energy, the fixing device is requested to heat the endless belt more efficiently. To address this request, a configuration to heat the endless belt directly, not via the metal thermal conductor, is proposed as shown in FIG. 2.

FIG. 2 illustrates a fixing device 20R2 in which the heater 300 heats the endless belt 100 directly. Instead of the metal thermal conductor 200 depicted in FIG. 1, a nip formation member 500 is disposed inside the loop formed by the endless belt 100 and presses against the pressing roller 400 via the endless belt 100 to form the fixing nip N between the endless belt 100 and the pressing roller 400. Since the nip formation member 500 does not encircle the heater 300 unlike the metal thermal conductor 200 depicted in FIG. 1, the heater 300 heats the endless belt 100 directly, thus improving heating efficiency for heating the endless belt 100.

FIG. 3 illustrates another fixing device 20R3 in which the heater 300 heats the endless belt 100 directly. Instead of the nip formation member 500 depicted in FIG. 2, the fixing device 20R3 includes a nip formation assembly 503 constructed of a base pad 501 and a low-friction sheet 502 wrapped around the base pad 501. As the endless belt 100 rotates counterclockwise in FIG. 3, it slides over the low-friction sheet 502 with a decreased friction therebetween, thus decreasing wear of the endless belt 100.

With the configurations of the fixing devices 20R1 and 20R2 described above, as the endless belt 100 rotates in accordance with rotation of the pressing roller 400, an upstream portion of the endless belt 100 disposed upstream from the fixing nip N in the rotation direction of the fixing belt 100 is pulled toward the fixing nip N by the rotating pressing roller 400. For example, an upstream portion 100*a* of the endless belt 100 of the fixing device 20R2 shown in FIG. 2, as it is pulled toward the fixing nip N, may strike an upstream edge 500*a* of the nip formation member 500 and therefore may be damaged or broken. Similarly, the low-friction sheet 502 of the fixing device 20R3 shown in FIG. 3 may strike an upstream edge 501*a* of the base pad 501 and therefore may wear. As the upstream portion 100*a* of the endless belt 100 strikes the upstream edge 501*a* of the base pad 501 no longer protected by the worn low-friction sheet 502, the upstream portion 100*a* of the endless belt 100 may be damaged or broken.

As the thinner endless belt 100 having a decreased mechanical strength is employed to shorten the first print time further and save more energy, a technology to minimize damage and breakage of the endless belt 100 is requested.

SUMMARY OF THE INVENTION

This specification describes below an improved fixing device. In one exemplary embodiment of the present invention, the fixing device includes an endless belt rotatable in a predetermined direction of rotation; a nip formation assembly disposed opposite an inner circumferential surface of the endless belt; and an opposed rotary body pressed against a part of the nip formation assembly via the endless belt to form a fixing nip between the endless belt and the opposed rotary body through which a recording medium bearing a toner image is conveyed. The nip formation assembly includes a base pad defining the fixing nip and including a pressure portion, an extension portion, and a curved portion. The pressure portion presses against the opposed rotary body via the endless belt. The extension portion is contiguous to and disposed upstream from the pressure portion in a recording medium conveyance direction. The extension portion does not press against the opposed rotary body via the endless belt but the endless belt slides over the extension portion. The curved portion is disposed upstream from the extension portion in the recording medium conveyance direction and smoothly blends into the extension portion. The curved portion does not press against the opposed rotary body.

This specification further describes an improved image forming apparatus. In one exemplary embodiment of the present invention, the image forming apparatus includes the fixing device described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
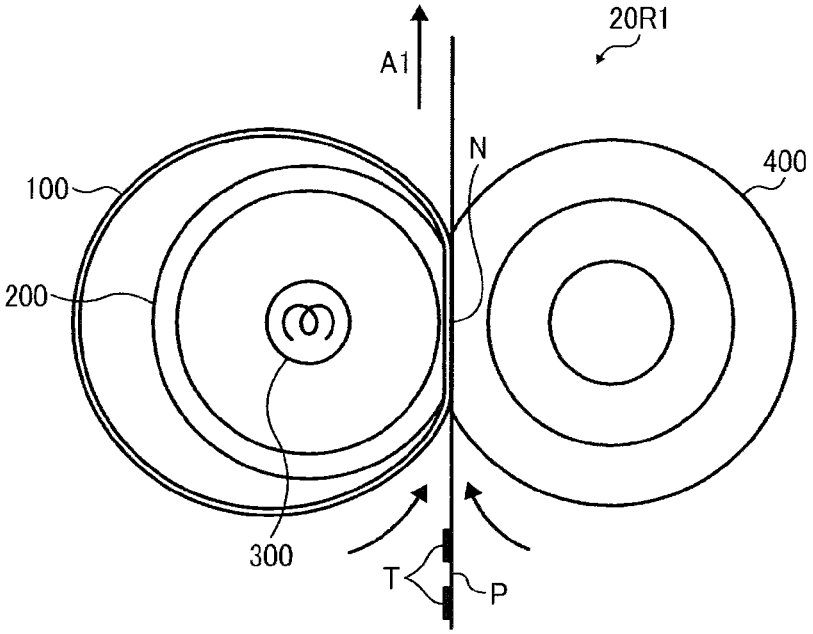
FIG. 1 RELATED ART
FIG. 1 is a vertical sectional view of a first related-art fixing device.
Figure 2:
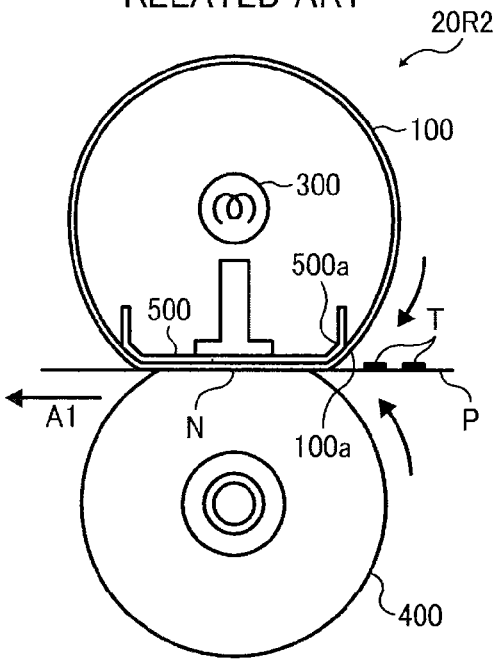
FIG. 2 RELATED ART
FIG. 2 is a vertical sectional view of a second related-art fixing device.
Figure 3:
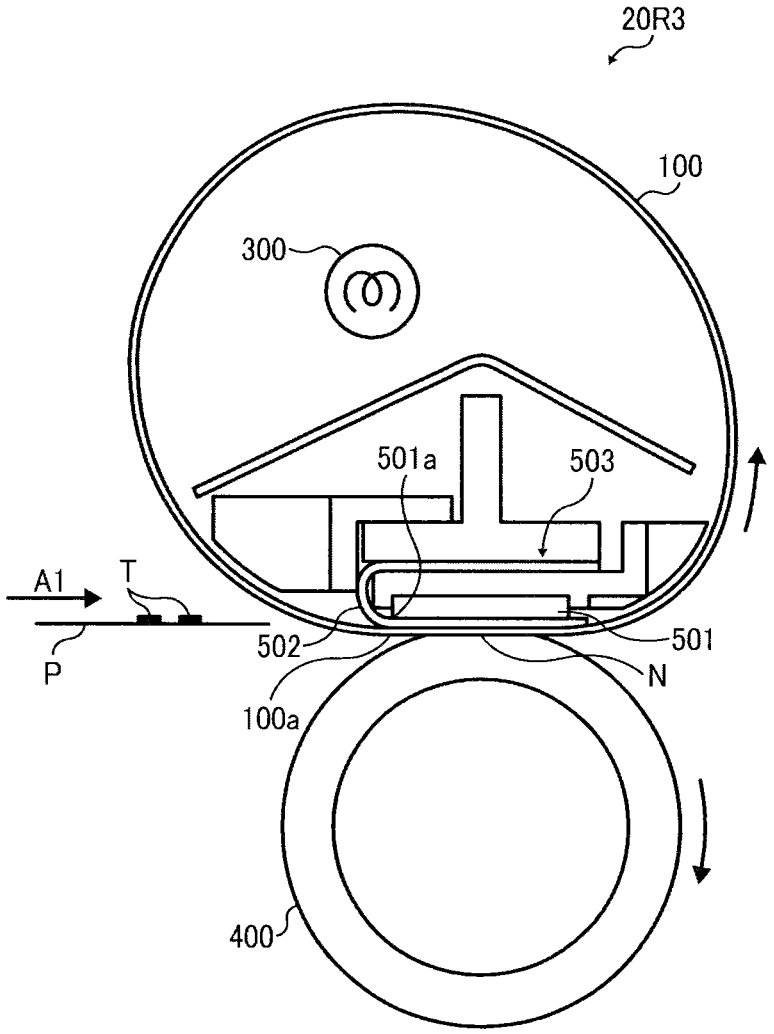
FIG. 3 RELATED ART
FIG. 3 is a vertical sectional view of a third related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 4:
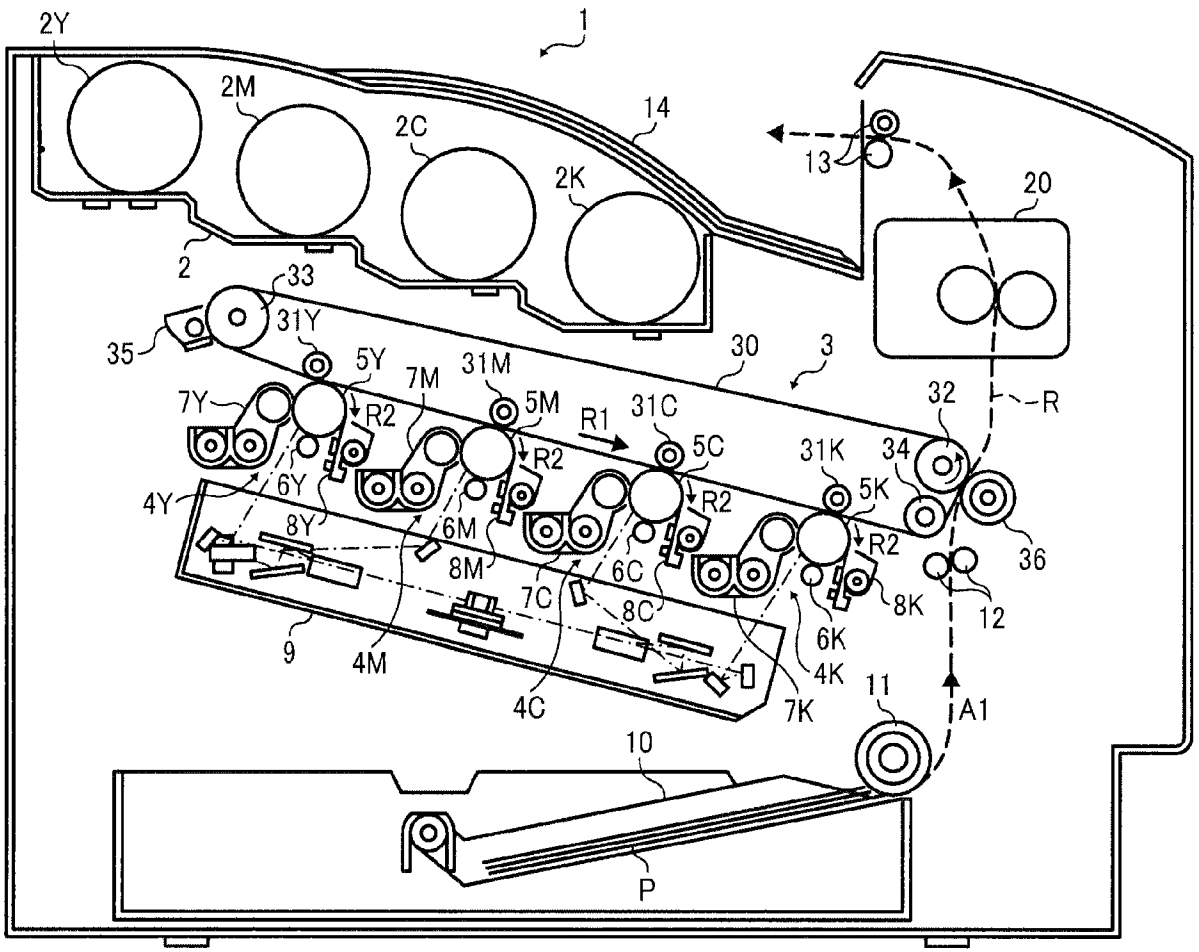
FIG. 4 is a schematic vertical sectional view of an image forming apparatus according to an exemplary embodiment of the present invention.

Referring now to the drawings, wherein like reference numerals designate identical or corresponding parts throughout the several views, in particular to FIG. 4, an image forming apparatus 1 according to an exemplary embodiment of the present invention is explained.

FIG. 4 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this exemplary embodiment, the image forming apparatus 1 is a color laser printer that forms a toner image on a recording medium P by electrophotography.

As shown in FIG. 4, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, the image forming devices 4Y, 4M, 4C, and 4K include drum-shaped photoconductors 5Y, 5M, 5C, and 5K serving as an image carrier that carries an electrostatic latent image and a resultant toner image; chargers 6Y, 6M, 6C, and 6K that charge an outer circumferential surface of the respective photoconductors 5Y, 5M, 5C, and 5K; development devices 7Y, 7M, 7C, and 7K that supply yellow, magenta, cyan, and black toners to the electrostatic latent images formed on the outer circumferential surface of the respective photoconductors 5Y, 5M, 5C, and 5K, thus visualizing the electrostatic latent images into yellow, magenta, cyan, and black toner images with the yellow, magenta, cyan, and black toners, respectively; and cleaners 8Y, 8M, 8C, and 8K that clean the outer circumferential surface of the respective photoconductors 5Y, 5M, 5C, and 5K.

Below the image forming devices 4Y, 4M, 4C, and 4K is an exposure device 9 that exposes the outer circumferential surface of the respective photoconductors 5Y, 5M, 5C, and 5K with laser beams. For example, the exposure device 9, constructed of a light source, a polygon mirror, an f-θ lens, reflection mirrors, and the like, emits a laser beam onto the outer circumferential surface of the respective photoconductors 5Y, 5M, 5C, and 5K according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31Y, 31M, 31C, and 31K serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched over the secondary transfer backup roller 32, the cleaning backup roller 33, and the tension roller 34. As a driver drives and rotates the secondary transfer backup roller 32 counterclockwise in FIG. 4, the secondary transfer backup roller 32 rotates the intermediate transfer belt 30 in a rotation direction R1 by friction therebetween.

The four primary transfer rollers 31Y, 31M, 31C, and 31K sandwich the intermediate transfer belt 30 together with the four photoconductors 5Y, 5M, 5C, and 5K, respectively, forming four primary transfer nips between the intermediate transfer belt 30 and the photoconductors 5Y, 5M, 5C, and 5K. The primary transfer rollers 31Y, 31M, 31C, and 31K are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31Y, 31M, 31C, and 31K, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the development devices 7Y, 7M, 7C, and 7K through toner supply tubes interposed between the toner bottles 2Y, 2M, 2C, and 2K and the development devices 7Y, 7M, 7C, and 7K, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, tracing paper, OHP (overhead projector) transparencies, OHP film sheets, and the like. Additionally, a bypass tray may be attached to the image forming apparatus 1 that loads postcards, envelopes, OHP transparencies, OHP film sheets, and the like.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 4, a description is provided of an image forming operation of the image forming apparatus 1 having the structure described above to form a color toner image on a recording medium P.

As a print job starts, a driver drives and rotates the photoconductors 5Y, 5M, 5C, and 5K of the image forming devices 4Y, 4M, 4C, and 4K, respectively, clockwise in FIG. 4 in a rotation direction R2. The chargers 6Y, 6M, 6C, and 6K uniformly charge the outer circumferential surface of the respective photoconductors 5Y, 5M, 5C, and 5K at a predetermined polarity. The exposure device 9 emits laser beams onto the charged outer circumferential surface of the respective photoconductors 5Y, 5M, 5C, and 5K according to yellow, magenta, cyan, and black image data contained in image data sent from the external device, respectively, thus forming electrostatic latent images thereon. The development devices 7Y, 7M, 7C, and 7K supply yellow, magenta, cyan, and black toners to the electrostatic latent images formed on the photoconductors 5Y, 5M, 5C, and 5K, visualizing the electrostatic latent images into yellow, magenta, cyan, and black toner images, respectively.

Simultaneously, as the print job starts, the secondary transfer backup roller 32 is driven and rotated counterclockwise in FIG. 4, rotating the intermediate transfer belt 30 in the rotation direction R1 by friction therebetween. A power supply applies a constant voltage or a constant current control voltage having a polarity opposite a polarity of the toner to the primary transfer rollers 31Y, 31M, 31C, and 31K. Thus, a transfer electric field is created at the primary transfer nips formed between the primary transfer rollers 31Y, 31M, 31C, and 31K and the photoconductors 5Y, 5M, 5C, and 5K, respectively.

When the yellow, magenta, cyan, and black toner images formed on the photoconductors 5Y, 5M, 5C, and 5K reach the primary transfer nips, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 30 by the transfer electric field created at the primary transfer nips in such a manner that the yellow, magenta, cyan, and black toner images are superimposed successively on a same position on the intermediate transfer belt 30. Thus, the color toner image is formed on the intermediate transfer belt 30. After the primary transfer of the yellow, magenta, cyan, and black toner images from the photoconductors 5Y, 5M, 5C, and 5K onto the intermediate transfer belt 30, the cleaners 8Y, 8M, 8C, and 8K remove residual toner not transferred onto the intermediate transfer belt 30 and therefore remaining on the photoconductors 5Y, 5M, 5C, and 5K therefrom. Thereafter, dischargers discharge the outer circumferential surface of the respective photoconductors 5Y, 5M, 5C, and 5K, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner not transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 5:
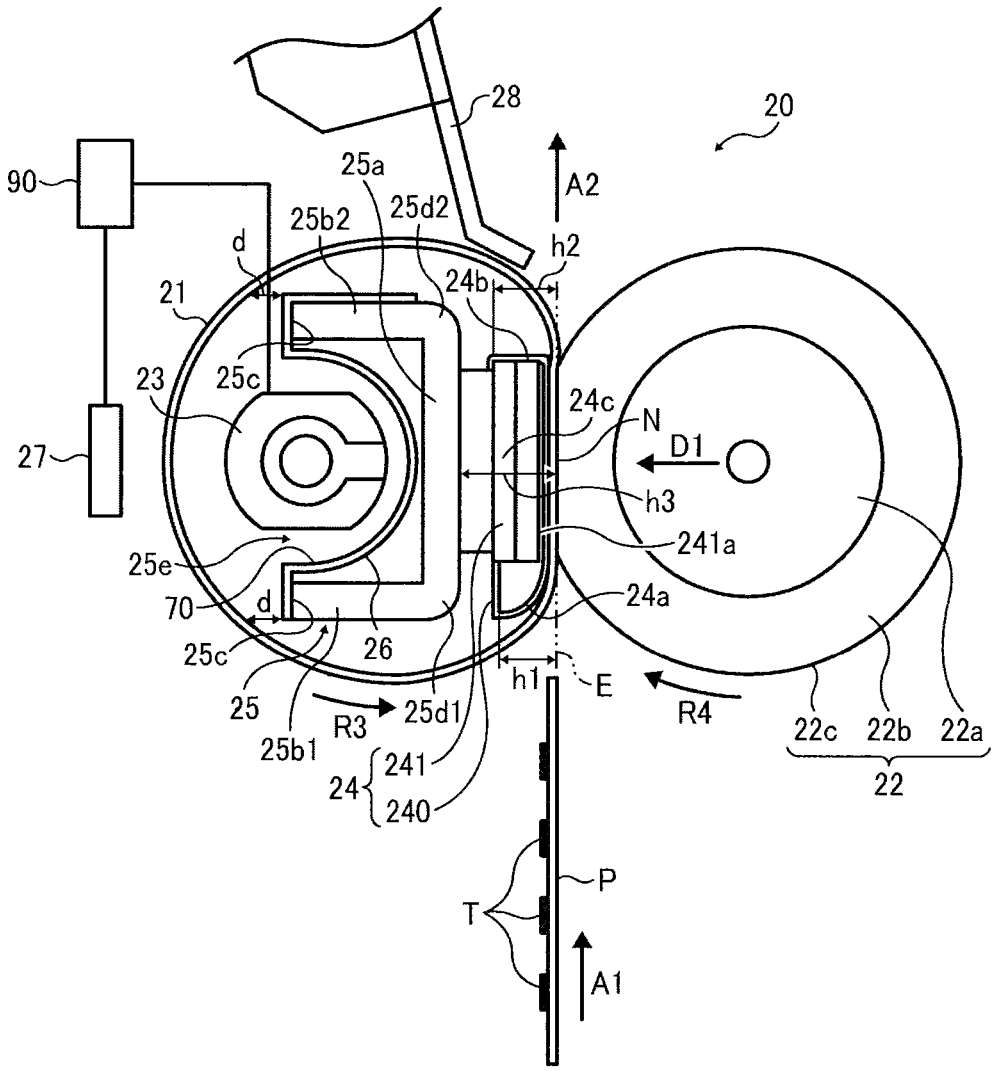
FIG. 5 is a vertical sectional view of a fixing device installed in the image forming apparatus shown in FIG. 4.

With reference to FIG. 5, a description is provided of a construction of the fixing device 20 incorporated in the image forming apparatus 1 described above.

FIG. 5 is a vertical sectional view of the fixing device 20. As shown in FIG. 5, the fixing device 20 (e.g., a fuser) includes a fixing belt 21 serving as a fixing rotary body or an endless belt formed into a loop and rotatable in a rotation direction R3; a pressing roller 22 serving as an opposed rotary body disposed opposite an outer circumferential surface of the fixing belt 21 and rotatable in a rotation direction R4 counter to the rotation direction R3 of the fixing belt 21; a halogen heater 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater 23 toward the fixing belt 21; a temperature sensor 27 serving as a temperature detector disposed opposite the outer circumferential surface of the fixing belt 21 and detecting the temperature of the fixing belt 21; and a separator 28 disposed opposite the outer circumferential surface of the fixing belt 21 and separating the recording medium P from the fixing belt 21. The fixing device 20 further includes a pressurization assembly that presses the pressing roller 22 against the nip formation assembly 24 via the fixing belt 21.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer, made of rubber such as silicone rubber, silicone rubber foam, and fluoro rubber, may be interposed between the base layer and the release layer.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. A driver (e.g., a motor) disposed inside the image forming apparatus 1 depicted in FIG. 4 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. If the pressing roller 22 does not incorporate the elastic layer 22*b*, the pressing roller 22 has a decreased thermal capacity that improves fixing performance of being heated to the predetermined fixing temperature quickly. However, as the pressing roller 22 and the fixing belt 21 sandwich and press a toner image T on the recording medium P passing through the fixing nip N, slight surface asperities of the fixing belt 21 may be transferred onto the toner image T on the recording medium P, resulting in variation in gloss of the solid toner image T.

To address this problem, it is preferable that the pressing roller 22 incorporates the elastic layer 22*b* having a thickness not smaller than about 100 micrometers. The elastic layer 22*b* having the thickness not smaller than about 100 micrometers elastically deforms to absorb slight surface asperities of the fixing belt 21, preventing variation in gloss of the toner image T on the recording medium P. The elastic layer 22*b* is made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21. According to this exemplary embodiment, the pressing roller 22 is pressed against the fixing belt 21. Alternatively, the pressing roller 22 may merely contact the fixing belt 21 with no pressure therebetween.

A detailed description is now given of a configuration of the halogen heater 23.

Both lateral ends of the halogen heater 23 in a longitudinal direction thereof parallel to an axial direction of the fixing belt 21 are mounted on side plates of the fixing device 20, respectively. A power supply situated inside the image forming apparatus 1 supplies power to the halogen heater 23 so that the halogen heater 23 heats the fixing belt 21. A controller 90, that is, a central processing unit (CPU), provided with a random-access memory (RAM) and a read-only memory (ROM), for example, operatively connected to the halogen heater 23 and the temperature sensor 27 controls the halogen heater 23 based on the temperature of the fixing belt 21 detected by the temperature sensor 27 so as to adjust the temperature of the fixing belt 21 to a desired fixing temperature. Alternatively, an induction heater, a resistance heat generator, a carbon heater, or the like may be employed as a heater to heat the fixing belt 21 instead of the halogen heater 23.

A detailed description is now given of a construction of the nip formation assembly 24.

The nip formation assembly 24 includes a base pad 241 and a slide sheet 240 (e.g., a low-friction sheet) covering an outer surface of the base pad 241. A longitudinal direction of the base pad 241 is parallel to an axial direction of the fixing belt 21 or the pressing roller 22. The base pad 241 receives pressure from the pressing roller 22 to define the shape of the fixing nip N. The base pad 241 is mounted on and supported by the stay 25. Accordingly, even if the base pad 241 receives pressure from the pressing roller 22, the base pad 241 is not bent by the pressure and therefore produces a uniform nip width throughout the axial direction of the pressing roller 22. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as liquid crystal polymer (LCP), metal, ceramic, or the like.

The base pad 241 is made of a heat-resistant material having a heat resistance temperature not lower than about 200 degrees centigrade. Accordingly, even if the base pad 241 is heated to a predetermined fixing temperature range, the base pad 241 is not thermally deformed, thus retaining the desired shape of the fixing nip N stably and thereby maintaining the quality of the fixed toner image T on the recording medium P. For example, the base pad 241 is made of general heat-resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The slide sheet 240 is interposed at least between the base pad 241 and the fixing belt 21. For example, the slide sheet 240 covers at least an opposed face 241*a* of the base pad 241 disposed opposite the fixing belt 21 at the fixing nip N. As the fixing belt 21 rotates in the rotation direction R3, it slides over the slide sheet 240, decreasing a driving torque exerted on the fixing belt 21. Accordingly, a decreased friction is imposed onto the fixing belt 21 from the nip formation assembly 24. Alternatively, the nip formation assembly 24 may not incorporate the slide sheet 240.

A detailed description is now given of a construction of the reflector 26.

The reflector 26 is interposed between the stay 25 and the halogen heater 23. According to this exemplary embodiment, the reflector 26 is mounted on the stay 25. For example, the reflector 26 is made of aluminum, stainless steel, or the like. The reflector 26 has a reflection face 70 that reflects light radiated from the halogen heater 23 thereto toward the fixing belt 21. Accordingly, the fixing belt 21 receives an increased amount of light from the halogen heater 23 and thereby is heated efficiently. Additionally, the reflector 26 minimizes transmission of radiation heat from the halogen heater 23 to the stay 25, thus saving energy.

The fixing device 20 according to this exemplary embodiment attains various improvements to save more energy and shorten a first print time required to output a recording medium P bearing a fixed toner image T onto the outside of the image forming apparatus 1 depicted in FIG. 4 after the image forming apparatus 1 receives a print job. As a first improvement, the fixing device 20 employs a direct heating method in which the halogen heater 23 directly heats the fixing belt 21 at a portion thereof other than a nip portion thereof facing the fixing nip N. For example, as shown in FIG. 5, no component is interposed between the halogen heater 23 and the fixing belt 21 at an outward portion of the fixing belt 21 disposed opposite the temperature sensor 27. Accordingly, radiation heat from the halogen heater 23 is directly transmitted to the fixing belt 21 at the outward portion thereof.

As a second improvement, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. The loop diameter of the fixing belt 21 is in a range of from about 20 mm to about 40 mm. In order to decrease the thermal capacity of the fixing belt 21 further, the fixing belt 21 may have a total thickness not greater than about 0.20 mm, preferably not greater than about 0.16 mm. Additionally, the loop diameter of the fixing belt 21 may be not greater than about 30 mm.

According to this exemplary embodiment, the pressing roller 22 has a diameter in a range of from about 20 mm to about 40 mm so that the loop diameter of the fixing belt 21 is equivalent to the diameter of the pressing roller 22. However, the loop diameter of the fixing belt 21 and the diameter of the pressing roller 22 are not limited to the above. For example, the loop diameter of the fixing belt 21 may be larger than the diameter of the pressing roller 22. In this case, the curvature of the fixing belt 21 at the fixing nip N is smaller than that of the pressing roller 22, facilitating separation of the recording medium P discharged from the fixing nip N from the fixing belt 21.

Since the fixing belt 21 has a decreased loop diameter, space inside the loop formed by the fixing belt 21 is small. To address this circumstance, both ends of the stay 25 in the recording medium conveyance direction A1 are folded into a bracket that accommodates the halogen heater 23. Thus, the stay 25 and the halogen heater 23 are placed in the small space inside the loop formed by the fixing belt 21.

In contrast to the stay 25, the nip formation assembly 24 is compact, thus allowing the stay 25 to extend as long as possible in the small space inside the loop formed by the fixing belt 21. For example, the length of the base pad 241 of the nip formation assembly 24 is smaller than that of the stay 25 in the recording medium conveyance direction A1. As shown in FIG. 5, the base pad 241 includes an upstream portion 24*a* disposed upstream from the fixing nip N in the recording medium conveyance direction A1; a downstream portion 24*b* disposed downstream from the fixing nip N in the recording medium conveyance direction A1; and a center portion 24*c* interposed between the upstream portion 24*a* and the downstream portion 24*b* in the recording medium conveyance direction A1. A height h1 defines a height of the upstream portion 24*a* from the fixing nip N or its hypothetical extension E in a pressurization direction D1 of the pressing roller 22. A height h2 defines a height of the downstream portion 24*b* from the fixing nip N or its hypothetical extension E in the pressurization direction D1 of the pressing roller 22. A height h3, that is, a maximum height of the base pad 241, defines a height of the center portion 24*c* from the fixing nip N or its hypothetical extension E in the pressurization direction D1 of the pressing roller 22. The height h3 is not smaller than the height h1 and the height h2.

Hence, the upstream portion 24*a* of the base pad 241 of the nip formation assembly 24 is not interposed between the inner circumferential surface of the fixing belt 21 and an upstream curve 25*d*1 of the stay 25 in a diametrical direction of the fixing belt 21. Similarly, the downstream portion 24*b* of the base pad 241 of the nip formation assembly 24 is not interposed between the inner circumferential surface of the fixing belt 21 and a downstream curve 25*d*2 of the stay 25 in the diametrical direction of the fixing belt 21 and the pressurization direction D1 of the pressing roller 22. Accordingly, the upstream curve 25*d*1 and the downstream curve 25*d*2 of the stay 25 are situated in proximity to the inner circumferential surface of the fixing belt 21. Consequently, the stay 25 having an increased size that enhances the mechanical strength thereof is accommodated in the limited space inside the loop formed by the fixing belt 21. As a result, the stay 25, with its enhanced mechanical strength, supports the nip formation assembly 24 properly, preventing bending of the nip formation assembly 24 caused by pressure from the pressing roller 22 and thereby improving fixing performance.

As shown in FIG. 5, the stay 25 includes a base 25*a* contacting the nip formation assembly 24 and an upstream projection 25*b*1 and a downstream projection 25*b*2, constituting a pair of projections, projecting from the base 25*a*. The base 25*a* extends in the recording medium conveyance direction A1, that is, a vertical direction in FIG. 5. The upstream projection 25*b*1 and the downstream projection 25*b*2 project from an upstream end and a downstream end of the base 25*a*, respectively, in the recording medium conveyance direction A1 and extend in the pressurization direction D1 of the pressing roller 22 orthogonal to the recording medium conveyance direction A1. The upstream projection 25*b*1 and the downstream projection 25*b*2 projecting from the base 25*a* in the pressurization direction D1 of the pressing roller 22 elongate a cross-sectional area of the stay 25 in the pressurization direction D1 of the pressing roller 22, increasing the section modulus and the mechanical strength of the stay 25. As described above, the upstream projection 25*b*1, the base 25*a*, and the downstream projection 25*b*2, formed into a bracket in cross-section, create a recess 25*e* that houses the halogen heater 23.

Additionally, as the upstream projection 25*b*1 and the downstream projection 25*b*2 elongate further in the pressurization direction D1 of the pressing roller 22, the mechanical strength of the stay 25 becomes greater. Accordingly, it is preferable that a front edge 25*c* of each of the upstream projection 25*b*1 and the downstream projection 25*b*2 is situated as close as possible to the inner circumferential surface of the fixing belt 21 to allow the upstream projection 25*b*1 and the downstream projection 25*b*2 to project longer from the base 25*a* in the pressurization direction D1 of the pressing roller 22. However, since the fixing belt 21 swings or vibrates as it rotates, if the front edge 25*c* of each of the upstream projection 25*b*1 and the downstream projection 25*b*2 is excessively close to the inner circumferential surface of the fixing belt 21, the swinging or vibrating fixing belt 21 may come into contact with the upstream projection 25*b*1 or the downstream projection 25*b*2. For example, if the thin fixing belt 21 is used as in this exemplary embodiment, the thin fixing belt 21 swings or vibrates substantially. Accordingly, it is necessary to position the front edge 25*c* of each of the upstream projection 25*b*1 and the downstream projection 25*b*2 with respect to the fixing belt 21 carefully.

Specifically, as shown in FIG. 5, a distance d between the front edge 25*c* of each of the upstream projection 25*b*1 and the downstream projection 25*b*2 and the inner circumferential surface of the fixing belt 21 in the pressurization direction D1 of the pressing roller 22 is at least about 2.0 mm, preferably not smaller than about 3.0 mm. Conversely, if the fixing belt 21 is thick and therefore barely swings or vibrates, the distance d is about 0.02 mm. It is to be noted that if the reflector 26 is attached to the front edge 25*c* of each of the upstream projection 25*b*1 and the downstream projection 25*b*2 as in this exemplary embodiment, the distance d is determined by considering the thickness of the reflector 26 so that the reflector 26 does not contact the fixing belt 21.

The front edge 25*c* of each of the upstream projection 25*b*1 and the downstream projection 25*b*2 situated as close as possible to the inner circumferential surface of the fixing belt 21 allows the upstream projection 25*b*1 and the downstream projection 25*b*2 to project longer from the base 25*a* in the pressurization direction D1 of the pressing roller 22. Accordingly, even if the fixing belt 21 has a decreased loop diameter, the stay 25 having the longer upstream projection 25*b*1 and the longer downstream projection 25*b*2 attains an enhanced mechanical strength.

Figure 6A:
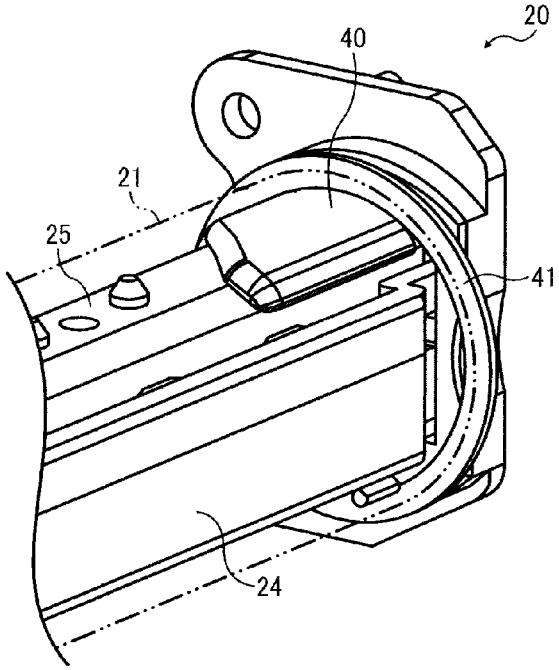
FIG. 6A is a perspective view of one lateral end of a fixing belt incorporated in the fixing device shown in FIG. 5 in an axial direction of the fixing belt.
Figure 6B:
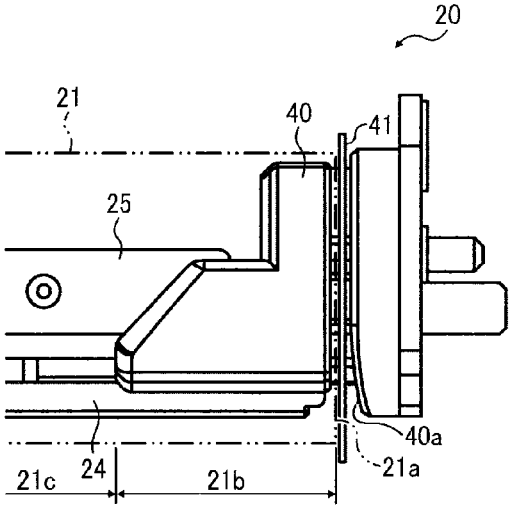
FIG. 6B is a plan view of one lateral end of the fixing belt shown in FIG. 6A in the axial direction thereof.
Figure 6C:
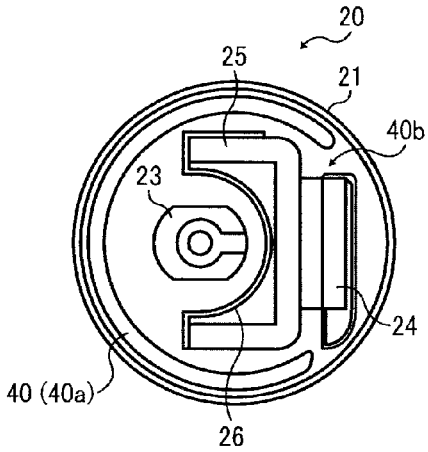
FIG. 6C is a vertical sectional view of one lateral end of the fixing belt shown in FIG. 6A in the axial direction thereof.

With reference to FIGS. 6A, 6B, and 6C, a description is provided of a configuration of a lateral end of the fixing belt 21 in the axial direction thereof.

FIG. 6A is a perspective view of one lateral end of the fixing belt 21 in the axial direction thereof. FIG. 6B is a plan view of one lateral end of the fixing belt 21 in the axial direction thereof. FIG. 6C is a vertical sectional view of one lateral end of the fixing belt 21 in the axial direction thereof. Although not shown, another lateral end of the fixing belt 21 in the axial direction thereof has the identical configuration shown in FIGS. 6A to 6C. Hence, the following describes the configuration of one lateral end of the fixing belt 21 in the axial direction thereof with reference to FIGS. 6A to 6C.

As shown in FIGS. 6A and 6B, a belt holder 40 is inserted into the loop formed by the fixing belt 21 at a lateral end 21*b* of the fixing belt 21 in the axial direction thereof to rotatably support the fixing belt 21. As shown in FIG. 6B, the belt holder 40 contacts and rotatably supports each lateral end 21*b* of the fixing belt 21 in the axial direction thereof. Conversely, the nip formation assembly 24 contacts and supports a center 21*c* of the fixing belt 21 in the axial direction thereof. As shown in FIG. 6C, the belt holder 40 is C-shaped in cross-section to create an opening 40*b* disposed opposite the fixing nip N where the nip formation assembly 24 is situated. As shown in FIG. 6B, a lateral end of the stay 25 in a longitudinal direction thereof parallel to the axial direction of the fixing belt 21 is mounted on and positioned by the belt holder 40.

As shown in FIG. 6B, a slip ring 41 is interposed between a lateral edge 21*a* of the fixing belt 21 and an inward face 40*a* of the belt holder 40 disposed opposite the lateral edge 21*a* of the fixing belt 21 in the axial direction thereof. The slip ring 41 serves as a protector that protects the lateral end 21*b* of the fixing belt 21 in the axial direction thereof. For example, even if the fixing belt 21 is skewed in the axial direction thereof, the slip ring 41 prevents the lateral edge 21*a* of the fixing belt 21 from coming into contact with the inward face 40*a* of the belt holder 40 directly, thus minimizing wear and breakage of the lateral edge 21*a* of the fixing belt 21 in the axial direction thereof. Since an inner diameter of the slip ring 41 is sufficiently greater than an outer diameter of the belt holder 40, the slip ring 41 loosely slips on the belt holder 40. Accordingly, when the lateral edge 21*a* of the fixing belt 21 comes into contact with the slip ring 41, the slip ring 41 is rotatable in accordance with rotation of the fixing belt 21. Alternatively, the slip ring 41 may be stationary irrespective of rotation of the fixing belt 21. The slip ring 41 is made of heat-resistant, super engineering plastics such as PEEK, PPS, PAI, and PTFE.

A shield is interposed between the halogen heater 23 and the fixing belt 21 at both lateral ends 21*b* of the fixing belt 21 in the axial direction thereof. The shield shields the fixing belt 21 against heat from the halogen heater 23. For example, even if a plurality of small recording media P is conveyed through the fixing nip N continuously, the shield prevents heat from the halogen heater 23 from being conducted to both lateral ends 21*b* of the fixing belt 21 in the axial direction thereof where the small recording media P are not conveyed. Accordingly, both lateral ends 21*b* of the fixing belt 21 do not overheat even in the absence of large recording media P that draw heat therefrom. Consequently, the shield minimizes thermal wear and damage of the fixing belt 21.

With reference to FIG. 5, a description is provided of a fixing operation of the fixing device 20 described above.

As the image forming apparatus 1 depicted in FIG. 4 is powered on, the power supply supplies power to the halogen heater 23 and at the same time the driver drives and rotates the pressing roller 22 clockwise in FIG. 5 in the rotation direction R4. Accordingly, the fixing belt 21 rotates counterclockwise in FIG. 5 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the pressing roller 22 and the fixing belt 21 pressed by the pressing roller 22. The fixing belt 21 heated by the halogen heater 23 heats the recording medium P and at the same time the pressing roller 22 pressed against the fixing belt 21 and the fixing belt 21 together exert pressure to the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of the separator 28, the separator 28 separates the recording medium P from the fixing belt 21. Thereafter, the recording medium P is discharged by the output roller pair 13 depicted in FIG. 4 onto the outside of the image forming apparatus 1, that is, the output tray 14 where the recording media P are stocked.

Figure 7:
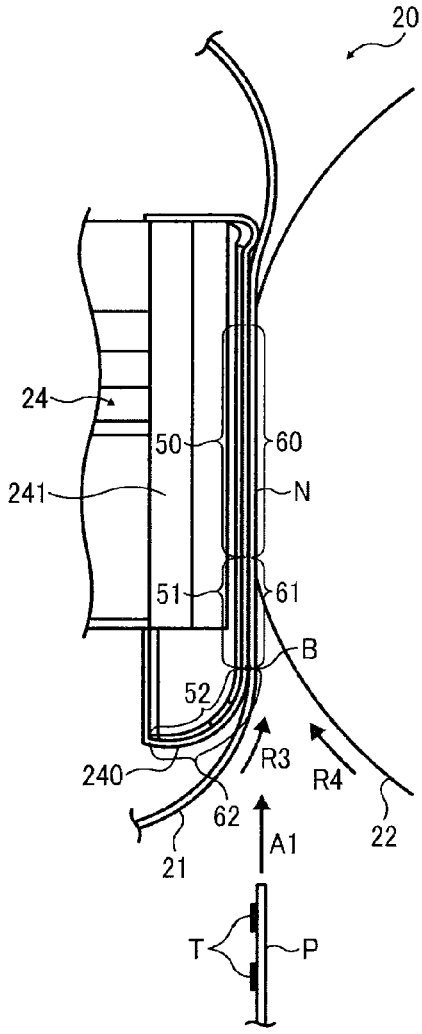
FIG. 7 is an enlarged vertical sectional view of a fixing nip formed between the fixing belt and a pressing roller incorporated in the fixing device shown in FIG. 5.

With reference to FIG. 7, a description is provided of a configuration of the fixing nip N formed between the pressing roller 22 and the fixing belt 21 of the fixing device 20.

FIG. 7 is an enlarged vertical sectional view of the fixing nip N formed between the pressing roller 22 and the fixing belt 21. As shown in FIG. 7, the base pad 241 of the nip formation assembly 24 includes an opposed face disposed opposite the pressing roller 22, which is constructed of a pressure portion 50 (e.g., a pressure face), an extension portion 51 (e.g., an extension face), and a curved portion 52 (e.g., a curved face). The pressure portion 50 is straight in the recording medium conveyance direction A1 and presses against the pressing roller 22 via the slide sheet 240 and the fixing belt 21. The extension portion 51 is disposed contiguous to and upstream from the pressure portion 50 in the recording medium conveyance direction A1. The extension portion 51 presses against the inner circumferential surface of the fixing belt 21 via the slide sheet 240 but does not press against the pressing roller 22. The extension portion 51 is straight in the recording medium conveyance direction A1 on an identical hypothetical plane where the pressure portion 50 is provided. As the fixing belt 21 rotates in the rotation direction R3, it slides over the extension portion 51 via the slide sheet 240 and enters the fixing nip N. That is, the extension portion 51 serves as a guide that guides the fixing belt 21 to the pressure portion 50 defining the fixing nip N.

According to this exemplary embodiment, the pressure portion 50 and the extension portion 51 are straight in the recording medium conveyance direction A1. Alternatively, the pressure portion 50 and the extension portion 51 may be concave with respect to the inner circumferential surface of the fixing belt 21 or may have other shapes. After a recording medium P is conveyed through the fixing nip N formed by the concave pressure portion 50 and the concave extension portion 51, the leading edge of the recording medium P is directed to the pressing roller 22, facilitating separation of the recording medium P from the fixing belt 21 and thereby minimizing conveyance failure of the recording medium P such as jamming of the recording medium P.

The curved portion 52 is contiguous to and upstream from the extension portion 51 in the recording medium conveyance direction A1. The curved portion 52 is convex toward the inner circumferential surface of the fixing belt 21. That is, the curved portion 52 projects toward the inner circumferential surface of the fixing belt 21 in the diametrical direction thereof. The curved portion 52 smoothly blends into the extension portion 51 through a border B between the curved portion 52 and the extension portion 51 so that the curved portion 52 and the extension portion 51 are not edged at the border B.

As described above, the base pad 241 includes the pressure portion 50 extending straight in the recording medium conveyance direction A1 and pressing against the pressing roller 22 via the fixing belt 21; the extension portion 51 contiguous to and upstream from the pressure portion 50 in the recording medium conveyance direction A1; and the curved portion 52 smoothly blending into the extension portion 51 and disposed upstream from the extension portion 51 in the recording medium conveyance direction A1. The slide sheet 240 adheres to the straight pressure portion 50, the straight extension portion 51 and the curved portion 52. For example, like the base pad 241, the slide sheet 240 includes a pressure portion 60 extending straight in the recording medium conveyance direction A1 and corresponding to the pressure portion 50 of the base pad 241; an extension portion 61 extending straight in the recording medium conveyance direction A1 and corresponding to the extension portion 51 of the base pad 241; and a curved portion 62 corresponding to the curved portion 52 of the base pad 241.

The fixing belt 21, as it halts, is isolated from the curved portion 62 of the slide sheet 240. Additionally, the curved portion 62 of the slide sheet 240 does not come into contact with the fixing belt 21 as the fixing belt 21 rotates on its desired rotation track without swinging or vibrating. Accordingly, even if the fixing belt 21 rotates, it does not come into contact with the curved portion 62 of the slide sheet 240. However, since the fixing belt 21 swings or vibrates slightly as it rotates, the fixing belt 21 may come into contact with the curved portion 62 of the slide sheet 240 accidentally. To address this circumstance, the curved portion 62 smoothly blends into the contiguous extension portion 61 because the curved portion 62 and the extension portion 61 of the slide sheet 240 adhere to the curved portion 52 and the extension portion 51 of the base pad 241. Thus, the curved portion 62 and the extension portion 61 of the slide sheet 240 minimize wear of the fixing belt 21 even if the fixing belt 21 accidentally slides over the curved portion 62 and the extension portion 61 of the slide sheet 240. Additionally, the curved portion 52 smoothly blending into the contiguous extension portion 51 of the base pad 241 minimizes wear of the slide sheet 240 caused by contact with the base pad 241.

In order to further decrease load imposed on the fixing belt 21 when the fixing belt 21 comes into contact with the curved portion 62 of the slide sheet 240, the curved portion 52 of the base pad 241 is shaped in accordance with the desired rotation track of the fixing belt 21.

As the fixing belt 21 rotates in the rotation direction R3, it is isolated from the curved portion 62 of the slide sheet 240 but in contact with the extension portion 61 of the slide sheet 240. That is, the fixing belt 21 enters the fixing nip N as it slides over the extension portion 61 of the slide sheet 240. Since the rotating fixing belt 21 is guided by the base pad 241 from the straight extension portion 51 to the straight pressure portion 50 thereof, the base pad 241 minimizes swinging or vibration of the fixing belt 21 before the fixing nip N, facilitating stable and smooth rotation of the fixing belt 21.

Even if the fixing belt 21 accidentally comes into contact with the curved portion 62 of the slide sheet 240 as it swings or vibrates during rotation, the curved portion 62 of the slide sheet 240 corresponding to the curved portion 52 of the base pad 241 smoothly blends into the extension portion 61 of the slide sheet 240 corresponding to the extension portion 51 of the base pad 241, minimizing wear of the fixing belt 21 precisely. Even if the fixing belt 21 presses the slide sheet 240 against the base pad 241 substantially, the shape of the curved portions 52 and 62 and the extension portions 51 and 61 minimizes wear of the slide sheet 240 precisely.

Even if the fixing belt 21 accidentally slides over the curved portion 52 and the extension portion 51 of the base pad 241, the fixing belt 21 is isolated from the pressing roller 22. Thus, friction between the fixing belt 21 and the pressing roller 22 that may wear the fixing belt 21 does not generate.

Figure 8:
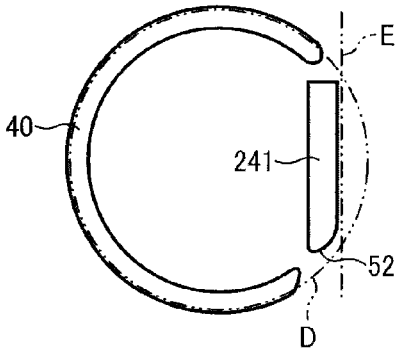
FIG. 8 is a vertical sectional view of a base pad and a belt holder incorporated in the fixing device shown in FIG. 5.

With reference to FIG. 8, a detailed description is now given of the position of the base pad 241.

FIG. 8 is a vertical sectional view of the base pad 241 and the belt holder 40. As shown in FIG. 8, the base pad 241 is situated as described below to keep the rotating fixing belt 21 away from the curved portion 62 of the slide sheet 240. A hypothetical circle D, that is, a perfect circle or a substantially perfect circle, indicated by the dotted line overlaps an outer circumference of the C-shaped belt holder 40. The hypothetical extension E indicated by the dotted line overlaps and extends from the fixing nip N in the recording medium conveyance direction A1. The curved portion 52 of the base pad 241 is situated at a position inside a region enclosed by the hypothetical circle D and the hypothetical extension E and spaced apart from the hypothetical circle D and the hypothetical extension E. Accordingly, the fixing belt 21 does not come into contact with the curved portion 62 of the slide sheet 240 adhered to the curved portion 52 of the base pad 241, minimizing load that may be imposed on the fixing belt 21 as it accidentally slides over the curved portion 62 of the slide sheet 240 and resultant wear of the fixing belt 21 precisely.

Figure 9:
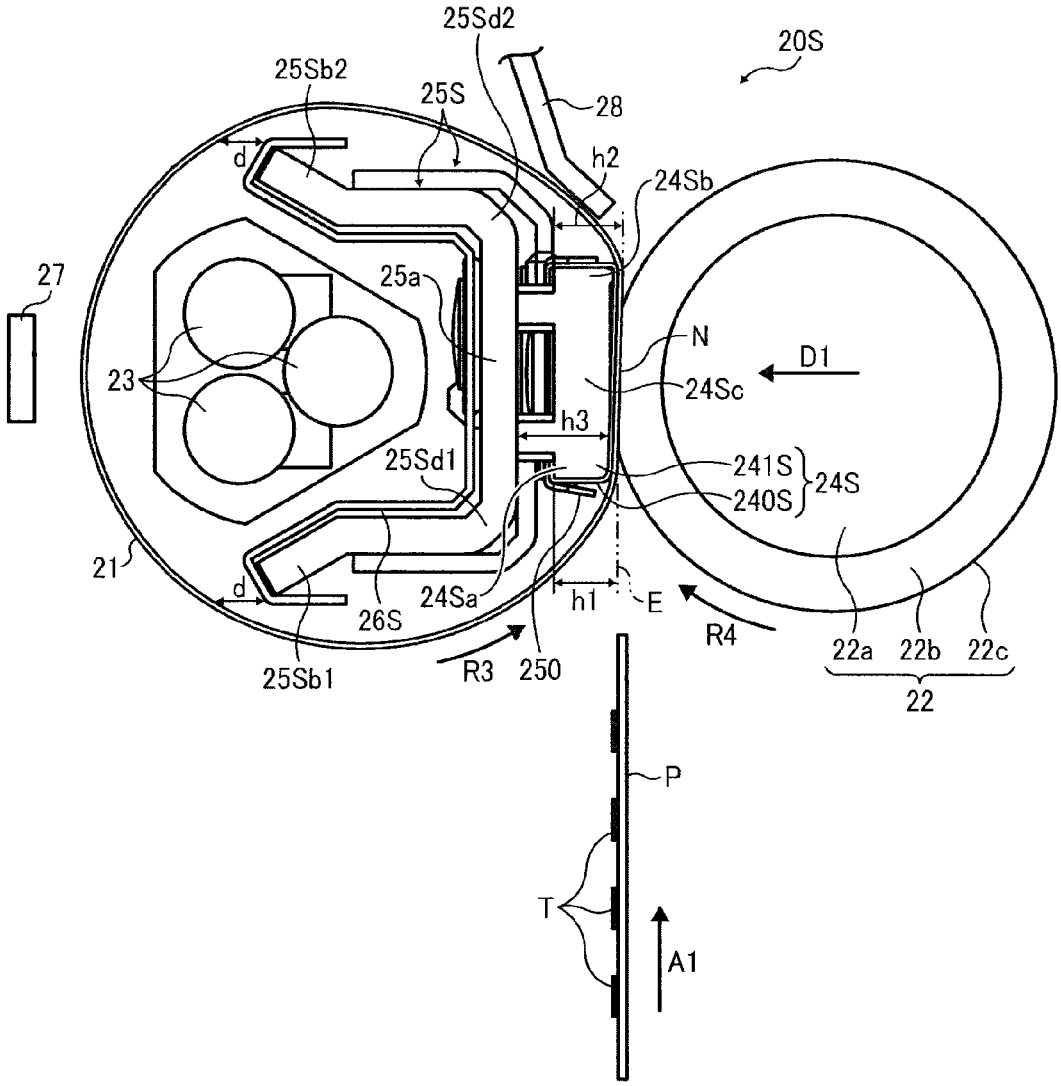
FIG. 9 is a vertical sectional view of a fixing device according to another exemplary embodiment of the present invention.
Figure 10:
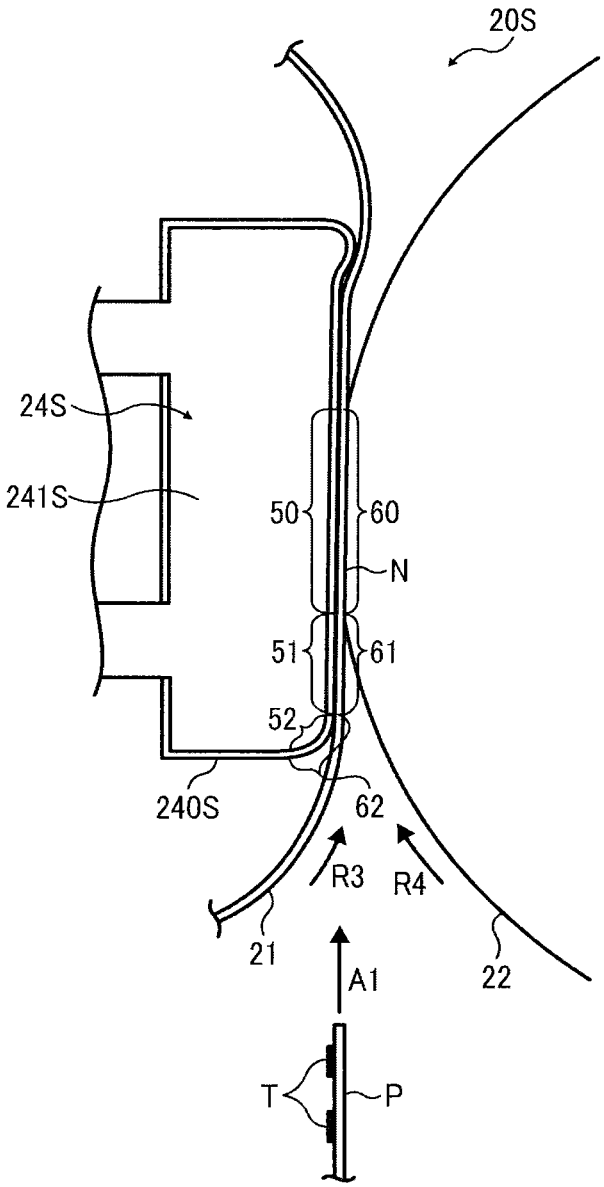
FIG. 10 is an enlarged vertical sectional view of the fixing nip formed between the fixing belt and the pressing roller incorporated in the fixing device shown in FIG. 9.

With reference to FIGS. 9 and 10, a description is provided of a configuration of a fixing device 20S according to another exemplary embodiment.

FIG. 9 is a vertical sectional view of the fixing device 20S. FIG. 10 is an enlarged vertical sectional view of the fixing nip N formed between the fixing belt 21 and the pressing roller 22 of the fixing device 20S. Unlike the fixing device 20 depicted in FIG. 5, the fixing device 20S includes three halogen heaters 23 serving as heaters that heat the fixing belt 21 as shown in FIG. 9. The three halogen heaters 23 have three different regions thereof in the axial direction of the fixing belt 21 that generate heat. Accordingly, the three halogen heaters 23 heat the fixing belt 21 in three different regions on the fixing belt 21, respectively, in the axial direction thereof so that the fixing belt 21 heats recording media P of various widths in the axial direction of the fixing belt 21. The fixing device 20S further includes a metal plate 250 that partially surrounds a nip formation assembly 24S. Thus, a stay 25S supports the nip formation assembly 24S via the metal plate 250.

Instead of the bracket-shaped stay 25 shown in FIG. 5, the fixing device 20S includes the substantially trapezoidal stay 25S that houses the three halogen heaters 23. For example, the stay 25S is constructed of the base 25*a*; an upstream projection 25Sb1 projecting from the base 25*a* and bent downward toward the inner circumferential surface of the fixing belt 21; and a downstream projection 25Sb2 projecting from the base 25*a* and bent upward toward the inner circumferential surface of the fixing belt 21. Instead of the reflector 26 shown in FIG. 5, the fixing device 20S includes a reflector 26S shaped in accordance with the shape of the stay 25S and mounted on the stay 25S.

As shown in FIG. 10, the fixing device 20S further includes the nip formation assembly 24S constructed of a base pad 241S having a shape different from the shape of the base pad 241 shown in FIG. 7 and a slide sheet 240S wrapped around the base pad 241S. Like the base pad 241 shown in FIG. 7, the base pad 241S includes the pressure portion 50, the extension portion 51 contiguous to the pressure portion 50, and the curved portion 52 contiguous to the extension portion 51, that facilitate stable and smooth rotation of the fixing belt 21 and minimize wear of the fixing belt 21. Similar to the heights h1, h2, and h3 shown in FIG. 5, the heights h1, h2, and h3 shown in FIG. 9 define the height of an upstream portion 24Sa of the base pad 241S, the height of a downstream portion 24Sb of the base pad 241S, and the height of a center portion 24Sc of the base pad 241S, respectively. In order to increase the size of the stay 25S disposed in the limited space inside the loop formed by the fixing belt 21, the height h3 is not smaller than the height h1 and the height h2.

As shown in FIG. 10, the extension portion 51 of the base pad 241S guides the fixing belt 21 sliding over the extension portion 51 via the extension portion 61 of the slide sheet 240S to the fixing nip N. Accordingly, even if only the nip formation assembly 24S guides the fixing belt 21 at the center in the axial direction thereof, the nip formation assembly 24S incorporating the base pad 241S having the extension portion 51 guides and rotates the fixing belt 21 stably and smoothly. Consequently, a reduced load is imposed on the rotating fixing belt 21. Even if the fixing belt 21 accidentally presses against the curved portion 52 of the base pad 241S via the curved portion 62 of the slide sheet 240S, the curved portion 52 smoothly blending into the extension portion 51 of the base pad 241S decreases friction between the fixing belt 21 and the slide sheet 240S wrapped around the base pad 241S, minimizing wear of the fixing belt 21 and the slide sheet 240S.

With reference to FIGS. 5, 7, 9, and 10, a description is provided of advantages of the fixing devices 20 and 20S.

The fixing devices 20 and 20S for fixing a toner image T on a recording medium P include the endless belt (e.g., the fixing belt 21) rotatable in the predetermined direction of rotation R3; the heater (e.g., the halogen heater 23) that heats the fixing belt 21; the nip formation assembly (e.g., the nip formation assemblies 24 and 24S) disposed inside the loop formed by the fixing belt 21; and the opposed rotary body (e.g., the pressing roller 22) that presses against the nip formation assembly via the fixing belt 21 to form the fixing nip N between the pressing roller 22 and the fixing belt 21. The nip formation assembly includes the base pad (e.g., the base pads 241 and 241S) that defines the shape of the fixing nip N and includes the pressure portion 50, the extension portion 51, and the curved portion 52. The pressure portion 50 presses against the pressing roller 22 via the fixing belt 21 so that the fixing belt 21 slides over the pressure portion 50. The extension portion 51 is contiguous to and disposed upstream from the pressure portion 50 in the recording medium conveyance direction A1. The extension portion 51 does not press against the pressing roller 22 but the fixing belt 21 slides over the extension portion 51. The curved portion 52 is disposed upstream from the extension portion 51 in the recording medium conveyance direction A1 and smoothly blends into the extension portion 51. The curved portion 52 does not press against the pressing roller 22.

The extension portion 51 of the base pad facilitates stable and smooth rotation of the fixing belt 21 and guides the fixing belt 21 to the fixing nip N. Accordingly, a reduced load is imposed on the fixing belt 21 as it rotates in the rotation direction R3. Even if the fixing belt 21 accidentally presses against the curved portion 52 of the base pad, the curved portion 52 smoothly blending into the extension portion 51 minimizes load imposed on the fixing belt 21, thus preventing wear of the fixing belt 21.

As described above, the nip formation assembly minimizes load imposed on the rotating fixing belt 21 and resultant wear of the fixing belt 21, preventing damage and breakage of the fixing belt 21 and enhancing reliability of the fixing devices 20 and 20S. For example, it is difficult for the fixing belt 21 having a reduced thickness that decreases the thermal capacity thereof to have an increased mechanical strength. However, the nip formation assembly according to the exemplary embodiments described above has an increased mechanical strength to support and guide the fixing belt 21, achieving the advantages described above.

The compact nip formation assembly guides the fixing belt 21 to the fixing nip N, facilitating stable and smooth rotation of the fixing belt 21. Accordingly, heat is not unnecessarily consumed on a guide that guides the fixing belt 21 to the fixing nip N, decreasing the thermal capacity of the entire fixing devices 20 and 20S. It is not necessary to provide a greater guide separately from the nip formation assembly. Hence, as shown in FIGS. 5 and 9, no component is interposed between the inner circumferential surface of the fixing belt 21 and the upstream curve of the stay (e.g., the upstream curve 25*d*1 of the stay 25 and an upstream curve 25Sd1 of the stay 25S) in the diametrical direction of the fixing belt 21. Similarly, no component is interposed between the inner circumferential surface of the fixing belt 21 and the downstream curve of the stay (e.g., the downstream curve 25*d*2 of the stay 25 and a downstream curve 25Sd2 of the stay 25S) in the diametrical direction of the fixing belt 21 and the pressurization direction D1 of the pressing roller 22. That is, the upstream curve and the downstream curve of the stay are disposed opposite the inner circumferential surface of the fixing belt 21 directly. Accordingly, the upstream curve and the downstream curve of the stay are situated in proximity to the inner circumferential surface of the fixing belt 21. Consequently, the stay having an increased size that enhances the mechanical strength thereof is accommodated in the limited space inside the loop formed by the fixing belt 21. As a result, even if the fixing belt 21 is downsized to decrease its thermal capacity, the stay accommodated inside the downsized fixing belt 21 achieves an enhanced mechanical strength that supports the nip formation assembly properly, preventing bending of the nip formation assembly caused by pressure from the pressing roller 22 and thereby improving fixing performance.

According to the exemplary embodiments described above, the nip formation assemblies 24 and 24S and the stays 25 and 25S are employed by the fixing devices 20 and 20S incorporating the thin fixing belt 21 having a reduced loop diameter to save more energy. Alternatively, the nip formation assemblies 24 and 24S and the stays 25 and 25S may be employed by other fixing devices. Additionally, as shown in FIG. 4, the image forming apparatus 1 incorporating the fixing device 20 or 20S is a color laser printer. Alternatively, the image forming apparatus 1 may be a monochrome printer, a copier, a facsimile machine, a multifunction printer (MFP) having at least one of copying, printing, facsimile, and scanning functions, or the like.

According to the exemplary embodiments described above, the pressing roller 22 serves as an opposed rotary body disposed opposite the fixing belt 21. Alternatively, a pressing belt or the like may serve as an opposed rotary body. Further, the halogen heater 23 disposed inside the fixing belt 21 serves as a heater that heats the fixing belt 21. Alternatively, the halogen heater 23 may be disposed outside the fixing belt 21.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an endless belt rotatable in a predetermined direction of rotation;

a nip formation assembly disposed opposite an inner circumferential surface of the endless belt;

an opposed rotary body pressed against a part of the nip formation assembly via the endless belt to form a fixing nip between the endless belt and the opposed rotary body through which a recording medium bearing a toner image is conveyed, and a belt holder contacting and rotatably supporting each lateral end of the endless belt in an axial direction thereof, the belt holder having a semi-circular shape with an opening therein so as to form a C-shaped cross-section and being oriented such that the opening faces the fixing nip, wherein the nip formation assembly includes a base pad defining the fixing nip, the base pad including:

a pressure portion pressing against the opposed rotary body via the endless belt, an extension portion contiguous to and disposed upstream from the pressure portion in a recording medium conveyance direction, the extension portion not pressing against the opposed rotary body via the endless belt, and the endless belt sliding over the extension portion, and a curved portion disposed upstream from the extension portion in the recording medium conveyance direction, the curved portion smoothly blending into the extension portion, and the curved portion not pressing against the opposed rotary body, wherein a location of the curved portion of the base pad relative to the belt holder is defined with respect to a hypothetical circle that overlaps an outer circumference of the C-shaped belt holder and a hypothetical plane that orthogonally intersects the hypothetical circle at two points so as to extend through the fixing nip in the recording medium conveyance direction, such that the curved portion is located inside a region enclosed by both the hypothetical circle and the hypothetical plane, and the curved portion being spaced apart from the hypothetical circle and the hypothetical plane.

2. The fixing device according to claim 1, wherein the endless belt is isolated from the curved portion of the base pad of the nip formation assembly when the endless belt is in a stopped position.

3. The fixing device according to claim 1, wherein the extension portion of the base pad is straight in the recording medium conveyance direction.

4. The fixing device according to claim 1, wherein the nip formation assembly further includes a low-friction sheet interposed at least between the base pad and the endless belt.

5. The fixing device according to claim 4, wherein the low-friction sheet adheres to the pressure portion, the extension portion, and the curved portion of the base pad.

6. The fixing device according to claim 1, wherein the curved portion of the base pad of the nip formation assembly projects toward the inner circumferential surface of the endless belt in a diametrical direction thereof.

7. The fixing device according to claim 1, wherein the base pad of the nip formation assembly further includes:

an upstream portion disposed upstream from the fixing nip in the recording medium conveyance direction and having a first height in a pressurization direction in which the opposed rotary body is pressed against the nip formation assembly via the endless belt;

a downstream portion disposed downstream from the fixing nip in the recording medium conveyance direction and having a second height in the pressurization direction of the opposed rotary body; and a center portion interposed between the upstream portion and the downstream portion in the recording medium conveyance direction and defining the fixing nip, the center portion having a third height in the pressurization direction of the opposed rotary body, and wherein the third height of the center portion is not smaller than the first height of the upstream portion and the second height of the downstream portion.

8. The fixing device according to claim 1, further comprising a heater disposed opposite the inner circumferential surface of the endless belt directly to heat the endless belt.

9. The fixing device according to claim 8, wherein the heater includes a halogen heater.

10. The fixing device according to claim 8, further comprising a support contacting and supporting the nip formation assembly, the support including:

a base;

an upstream projection disposed upstream from the base in the recording medium conveyance direction and projecting from the base toward the inner circumferential surface of the endless belt; and a downstream projection disposed downstream from the base in the recording medium conveyance direction and projecting from the base toward the inner circumferential surface of the endless belt, wherein the upstream projection and the downstream projection are disposed opposite the inner circumferential surface of the endless belt directly.

11. The fixing device according to claim 10, wherein the base, the upstream projection, and the downstream projection of the support create a recess housing the heater.

12. The fixing device according to claim 10, wherein a length of the base pad of the nip formation assembly is smaller than a length of the support in the recording medium conveyance direction.

13. The fixing device according to claim 10, further comprising a metal plate interposed between the nip formation assembly and the support and partially surrounding the nip formation assembly.

14. The fixing device according to claim 10, wherein the support includes a stay.

15. The fixing device according to claim 1, wherein the opposed rotary body includes a pressing roller.

16. An image forming apparatus comprising the fixing device according to claim 1.

17. The fixing device according to claim 1, wherein endless belt is maintained out of contact from the curved portion of the base pad.

18. The fixing device according to claim 1, further comprising a stay disposed entirely within the C-shaped cross-section of the belt holder, the stay having a pair of arms that extend away from the opening of the cross-section of the belt holder.

* * * * *